United States Patent [19]

Söremark et al.

[11] Patent Number: 4,857,126

[45] Date of Patent: Aug. 15, 1989

[54] PROCESS FOR TREATMENT OF PAPER SURFACES

[75] Inventors: Christer Söremark; Ingemar Olsson, both of Stromsnasbruk, Sweden

[73] Assignee: Sodra Skogsagarna AB, Stromsnasbruk, Sweden

[21] Appl. No.: 603,617

[22] Filed: Apr. 25, 1984

[51] Int. Cl.[4] ..... B31F 1/22; B05D 3/02; B05D 5/12

[52] U.S. Cl. ..... 156/205; 162/135; 427/361; 427/395

[58] Field of Search ..... 156/205, 210, 289; 162/135, 136, 184; 427/361, 362, 364, 391, 395; 428/511, 512, 533; 106/2, 130, 142; 264/300

[56] References Cited

U.S. PATENT DOCUMENTS

| | | | |
|---|---|---|---|
| 2,947,640 | 8/1960 | Ladeuze et al. | 106/2 |
| 3,312,564 | 4/1967 | Barbour | 427/391 X |
| 3,369,932 | 2/1968 | Sawyer, Jr. et al. | 427/391 X |
| 3,372,050 | 3/1968 | Weber | 427/391 X |
| 3,477,871 | 11/1969 | van Westrenen | 427/391 |
| 3,607,940 | 9/1971 | Miller, Jr. et al. | 106/2 X |
| 3,892,613 | 7/1975 | McDonald et al. | 156/205 X |
| 4,240,860 | 12/1980 | Pole et al. | 156/327 |
| 4,370,389 | 1/1983 | Ogura et al. | 162/135 X |

OTHER PUBLICATIONS

Kirk-Othmer, Encyclopedia of Chemical Tech. (1978 ed.), vol. 1, pp. 947-948; vol. 8, pp. 911, 914; vol. 21, pp. 177.

*Primary Examiner*—Michael W. Ball
*Assistant Examiner*—Ramon R. Hoch
*Attorney, Agent, or Firm*—Owen, Wickersham & Erickson

[57] ABSTRACT

In the making of coated paper products an improved process is disclosed for separating wet, semi-dry or dried coated paper from an application unit or a drying roll. The process comprises the steps of providing a paper web with a release composition in the form of an aqueous layer or film including the reaction product of alkanolamine and a fatty acid in equimolar proportions, providing an agent to maintain the pH factor to predetermined level and adding preselected amounts of a viscosity-regulating substance and water. The release composition may be applied directly to a drying roll or drum or to fluting rolls use for corrugated paperboard.

8 Claims, No Drawings

PROCESS FOR TREATMENT OF PAPER SURFACES

This invention relates to the surface coating of paper and impregnation operations of machines on paper, paperboard, corrugated and non-woven materials. More particularly it relates to improved compositions and methods for causing rapid and complete separation of the wet, tacky, coated web of paper product from the coating, drying, or processing surfaces of the machine.

BACKGROUND OF THE INVENTION

A commonly used method for applying a coating to a paper web in a paper machine is by using some type of roll applicator. A size press is one example using roll applicators. Heretofore, when coating in a size press, a more or less pronounced "orange peel" effect occurred, due to an adhesion force created between the coating mixture, the rolls, and the web, such that a part of the mixture often followed the rolls after the nip. This meant that the mixture split in two directions; i.e., the paper web and the rolls. That is, a short distance after the nip, the mixture "broke" and was sucked towards the paper and towards the roll, thereby creating minute spots of mixture which gave the paper the appearance of an orange peel, thereby resulting in an unsatisfactory paper product. A general object of the present invention is to provide a solution to the aforesaid problem.

Coatings used for such paper products can be roughly divided into two groups; namely pigment and functional. Pigment coating is the most common type and a mixture thereof comprises at least one pigment, for example, clay calcium carbonate, satin white or titanium dioxide. The main purposes of this kind of coating are: (1) to achieve an even surface which is favorable for printing color; (2) to obtain a better opacity in the final paper; and (3) to mask or change the color of the base paper.

Functional coating consists of coating or impregnating the paper in such a way that a special function is obtained. Properties which make the paper water repellent, grease resistant or impenetrable to water vapor are examples of functional coatings. In the examples mentioned above, it is important that the coating layer consists of a substantially even film, i.e., one of uniform depth or thickness; this is especially important when a water vapor barrier is needed. Also, analogous to pigment coating, no orange peel effect must occur. In a similar manner, this effect can be decreased or eliminated by adding small amounts of the bifunctional composition described below to the mixture. Another big problem is that the runability is very limited due to deposits on the rolls. In many cases, some kind of latices make the make the whole or most of the active part of the mixture. Examples of these are bases of styrene butadiene, acrylic acid or polyvinylidene chloride (PVDC). These, and especially PVDC, have an inherent tendency to stick to the rolls, thereby causing uneven coating and web breakage and this limits the running time because of the need for cleaning rolls.

A further object of the present invention is to provide an additive material for paper coatings which will reduce the aforesaid problems by enabling the machine rolls to be kept clean and thereby eliminate web breaks during continuous production.

During the manufacture of paper, another type of coating can be applied to obtain higher surface strength, decreased linting and higher stiffness. This type of coating is a solution of starch added either at the size press or at the calender stack. In calender sizing, the concentration of starch must be kept low to prevent web adhesion to the steel rolls and formation of strings and scabs that mark the web. At the size press, a high concentration of starch cannot be used because the web will adhere to the rolls and cause the web to break. Also the web may stick to the following dryer cans (also called drums or cylinders) or leave a starch coating on them that reduces drying efficiency. Thus, another object of the invention is to provide a bifunctional composition of the type mentioned above that will decrease adhesion of the paper web to the rolls and dryers while enabling the starch concentration to be increased. When the starch concentration is increased at the size press, less water is needed to apply the same amount of dry starch per square meter of paper, and this allows increased machine speed or the addition of more starch to the web.

SUMMARY OF THE INVENTION

In accordance with the principles of the present invention, a coating additive product is disclosed for use in making a coated, impregnated or sized paper or non-woven product, especially such a product as is coated by a coating roll or drum or dried on a drying roll or drum. This product is bifunctional and is characterized by having one end that is hydrophilic and the other is hydrophobic so that it reduces the tendency of the coating mixture to stick to the rolls and thereby helps to maintain cleaner rolls. With this additive product, a smoother coating surface on the paper is obtained and the coating amount increases because relatively little coating mixture follows with the rolls out of the nip during the coating process. Also, a valuable secondary effect is obtained by the decreased adhesion of the mixture to the roll, thereby increasing the time between the cleaning of the roll and reducing paper web breaks caused by excessive coating adhesion to the applicator roll. This latter effect applies to all cases when the mixture is in contact with movable, as well as stationary, elements of paper making machines such as metal, rubber, and stone, (e.g. different types of blade, rod and knife coating systems).

In use, the base web in a paper making machine which can be treated by the present invention, may be of any desired type. For instance, the additive may be used for treated magazine stock, board, stock for corrugated products, and woven or non-woven stock. The preparation of treated corrugated paper in the fluting device is particularly improved by use of the additive product as disclosed, with very little, if any, sticking of the wet coated corrugated product to the fluting roll. In making various coated paper products, there is added from about 0.5% to about 6%, by weight of the additive material to the percent by volume of the coating formulation, and usually from about 2%–3% thereof is advantageously employed. In surface sizing with starch, 2%–4% of additive may be used based on dry starch, and for functional coatings, 2%–6%, based on dispersion as received from a supplier.

According to the present invention, the additive material comprises a release composition, for inclusion in the coating material, which is comprised of equimolar amounts of an alkanolamine, polyalkylol amine or alkanol amine, selected from the group consisting of monoethanolamine, diethanolamine, triethanolamine, monoisopropanolamine, diisopropanolamine, triisopropanolamine, aminoethylethanolamine, diethylethanolamine and methyldiethanolamine, and of a fatty acid consisting from 11 to 18 carbon atoms. The additive product is made by combining the alkanolamine and the fatty acid in water and permitting them to react at room temperature or with gentle heat to form a product having the desired characteristics according to the invention. This release composition also contains an alkaline agent which is volatilizable under the conditions of casting or drying of treated paper stock, and which maintains the pH of the release composition at from 8 to 10. A viscosity reducing agent is also incorporated to enable intimate admixture of the release agent with the wet coating formulation and to make the addition product easier to handle in its concentrated form. This invention also comprises the method of making the release agent herein and the method of preparing paper and other products with incorporation of the above release agent.

One advantage of the present invention is that it provides a material that will assure the uniform release of a coated web from coating, forming or drying surfaces, thereby avoiding any orange peel effect, sticking and the like. A further advantage of the invention is that in making starch-coated paper products, larger amounts of starch, with consequent greater production economies, can be incorporated in the paper.

Another important advantage that has been found with this invention is the elimination of sticking in the fluting rolls, so that it is possible to use high water-resistant binder material on or in the fluted paper to later render a corrugated box resistant to moisture vapor. By means of the present invention, it is also possible to use higher concentrations of starch in starch-coating operation, while increasing the speed of the operation, because the higher concentrations operate well without sticking to machine rolls and thus causing downtime.

By the present invention, the cohesive forces between a coating or impregnating layer and a forming, drying or other type of roll are decreased, thereby enabling smooth removal of the coated or impregnated product while such forces between the coating or impregnating layer and the web are maintained so that splitting of the film or layer of coating is avoided during such removal.

Other objects, advantages and features of the invention will become apparent from the following detailed description thereof together with the examples presented.

DETAILED DESCRIPTION OF THE INVENTION

A release agent or composition that effects complete removal of a wet or dried coated paper or a woven or non-woven product from a coating or drying surface, in accordance with the present invention, comprises an addition product of substantially equimolar amounts of an alkanolamine and a fatty acid together with an agent to maintain the pH of the composition at from 8 to 10 and which is volatilizable under the conditions of use, and also an agent to reduce the viscosity of the composition. Advantageously, the alkanolamine is diethanolamine and the fatty acid is oleic acid.

In this disclosure, the alkanolamine employed is diethanolamine, $(C_2H_4OH)_2NH$, but it will be understood that other alkanolamines having 2 to 3 carbon atoms in the alkyl group can be used, such as monoethanolamine, diethanolamine, triethanolamine, monoisopropanolamine, diisopropanolamine or triisopropanolamine, aminoethylethanolamine, diethylethanolamine, methyldiethanolamine, or mixtures of these alkanolamines with each other in any desired proportion.

Also, in the samples herein, oleic acid $CH_3(CH_2)_7CH{=}CH(CH_2)_7COOH$, is employed as one reactant but there can also be used stearic acid, $C_{17}H_{35}COOH$, palmitic acid, $C_{15}H_{31}COOH$, linolenic acid, $CH_3(CH_2)_4CH{=}CHCH_2CH{=}CH(CH_2)_7COOH$, lauric acid, $C_{11}H_{23}COOH$, or linolenic acid, $CH_3CH_2CH{=}CHCH_2CH{=}CHCH_2CH{=}CH(CH_2)_7$-COOH. Mixtures of such acids with each other can also be used in any desired proportions. There can also be employed in the same manner, tall oil which has been refined to contain as major portion of the fatty acids thereof, oleic acid and linoleic acid.

In order to maintain the pH of the composition from 8 to 10, the volatilizable agent described hereinabove s advantageously $NH_3$ or $NH_4OH$ which volatilizes during the drying stage. Although $NH_4OH$ is preferred, other pH control agents can be used, such as NaOH, which however does not volatilize. Further, even an excess of the mentioned alkaline, alkanolamines can be used. Advantageously, it has been found that pH close to 9 gives very good results in the process of this invention.

A viscosity-reducing agent is also incorporated in order to make the addition product easier to handle and to mix into the coating formulation. Propionic acid is an advantageous additive for this purpose. However, there can also be used formic or acetic acid. The viscosity-reducing agent is added in an amount of from 1% to 5% by weight of the composition.

The alkanolamine and fatty acid are suitably combined to make the additive compound desired by mixing them together in water; the viscosity-regulating agent is added at room temperature, whereupon these components react to form the desired component. The mixture can be heated, if desired, to less than 100° C., to accelerate the reaction. The pH is then adjusted with the volatilizable agent described above. The viscosity regulator is advantageously present during reaction mentioned.

In preparing the paper products suitably, the paper is coated with starch or a pigment coating in the manner known to the art and the composition of this invention can be added to the coating formulation, with thorough mixing, prior to passing through the coating or drying rolls or drum. The term "coating rolls" is also meant to include fluting rolls or other devices as known in the industry.

The following examples will illustrate more clearly the present invention and the mode of carrying it out:

EXAMPLE 1

In order to get a suitable consistency of the addition product so that it can easily be mixed with the formulation for coating, it can be prepared, for example, in the following way:

In this example, we started with two components, oleic acid and diethanolamine. The diethanolamine was mixed with six (6) times its own weight of water and then an equimolar amount of oleic aid was added while stirring. Finally, 2.5% ammonia (25% aqueous solution) by weight and 2% propionic acid by weight were added so that a mixture of low viscosity was obtained rapidly.

The composition so produced typically was a yellowish water, containing components with surface-active and complex-forming properties, having an active content of approximately 42.5% and a pH close to 9.

For convenience, the release composition of this invention is referred to hereinafter as P-O.

EXAMPLE 2

A comparison between an "ordinary" coating mixture and one containing P-O was made in a size press on a pilot machine at a speed of 10 m/minute. The following sizing formula was used in the reference mixture:

| | | |
|---|---|---|
| 250 | liters | of water |
| 4 | liters | of Dispex N40 |
| 1 | liter | of Etingal S |
| 65 | kg | Paperade |
| 225 | kg | SPS clay |
| 1.5 | liters | Caustic soda (40%) |
| 135 | liters | Ammonia |
| 125 | liters | Dow 670 |

The modified mixture also contained a 2.5% by volume of P-O. As base paper for the coating, a 180 g/m²MF bleached kraft paper was used. Conventional paper testing did not show any significant advantages for the modified mixture. By an ocular inspection of the samples, made by five experienced printers and five experienced paper makers, all but one, who considered them equal, pointed out that the paperboard coated with the mixture containing P-O was the best, especially when smoothness (absence of orange peel) and absence of streaks is considered. Then the samples were printed with gravure printing. All considered the printing result of the modified sample better than of the reference.

EXAMPLE 3

In a product machine for paperboard, starch was added to the backside of the paper, to decrease the linting problem in the following working steps. Because of the thread formation of the mixture after the glazing-nip, no starch concentration higher than 10% has heretofore been possible when using starch solution such as $Solfarex_2A_{55}$. This gives an amount of coating of about 2 g/m², which is not enough to eliminate the linting problem completely. The cause of the runability problem, i.e., the adhesion to the rolls was eliminated by addition of 2% P-O on dry basis, and at the same time, the starch concentration was raised to 20%. The amount of starch on the paper was doubled (that gave 4 g/m²), which completely eliminated the linting problem. Further, an increase by 15% of the geometrical average of the stiffness value was observed. Since the stiffness is an important quality of the paperboard, the basis weight can so be decreased and raw material can be saved. At the same time, the amount of square meter of product per unit of time can be increased.

EXAMPLE 4

The purpose was to make a paperboard with high water and grease repellency, together with a low water vapor transmission. The equipment was a paperboard machine with a size press and a roll applicator without possibility of intermediate drying. To obtain the mentioned properties, it was planned to run coatings of styrene-butadiene latex (Dow 620) in the size press and PVDC polyvinylidene chloride available in commerce as Kurofan 233D in the roll applicator, both at the concentration at which they were delivered (50% and 58%, respectively). Because of the tendency of the two dispersions to deposit on the rolls, it was impossible to carry through with the experiment. In the following trial, first 4.0% by weight of P-O was added to each of the two undiluted dispersions. This resulted in a completely acceptable run. In the size press, about 3 g/m² Dow 620 and in the roll applicator, about 5 g/m² Kurofan 233D on dry basis was applied. The base paper was a WLC paperboard of 425 g/m² that was sized in the surface layer to Cobb 26. After the coating process was finished, the following very satisfactory properties of the product values were obtained:

| | |
|---|---|
| Cobb | 8 g/m² |
| Porosity | 780 sec/100 ml |
| Vapor transmission | 150 g/m²/24 hours |
| Grease resistancy | 5 according to the 3M method |

EXAMPLE 5

On a machine, where an undried starch-coated paper web was turned 90° over a rubber roll, picking appeared. This resulted in a vibrating and uneven clearance from the rubber roll, followed by a high frequency of web rupture. A long free draw (2 m) between this rubber roll and the following guide idler roll accentuated the adhesion problem. By running a 50 g/m² paper, coated with a 13% solution of Lyckeby starch 681M, the average winding angle is 11.0° between the web and the next roll instead of being 0° (leaving the roll tangentially). With an addition of 4% of P-O on dry basis, this angle decreased drastically and the clearance line became straight.

EXAMPLE 6

One particularly advantageous embodiment of the present invention is in the production of corrugated board. Such material is used, as is well known, to form strong packing boxes and the like, and is desirably weather-resistant. However, if wet things or iced products are packed in such materials, the corrugated paperboard tends to fail and collapse upon absorption of significant amounts of moisture, as may happen in shipping to tropical climates where the weather is too humid or when it contains goods packed in ice. It has heretofore not been possible to treat the flutings of the corrugated board economically with sufficient waterproofing substances because the fluting rolls through which the stock passes are heated to about 160° C. and the treated paperboard sticks to these rolls. This disrupts the operation. It has heretofore been proposed to dip or spray the finished box product with a molten wax, but this is expensive.

It has now been found that a waterproofing or water-resistant coating can be applied directly to the web to be fluted. By using the additive material of the present invention with the water-resistant coating, it was found that the web will not stick to the fluting rolls. For instance, an acrylic or other polymeric binder in sufficient amount to provide water-resistance was applied to the surface of the web along with 0.5% to 10% by weight of the release composition of this invention, calculated on dry basis of the polymer. The composition of Example 1 was used in an amount of 2%–6% by weight as received, and the web was then run through the fluting rolls without any sticking or disruption of the operation and with production of a satisfactory fluting.

In one previous process, the liner of the corrugated paperboard was coated in two steps with acrylic polymer to provide water-resistance. However, this method was not successful in treating the fluting because either the fluting stuck to the fluting cylinder or it was not possible to glue the finished fluting to the liner because it was impervious to the water-base glue.

To overcome this difficulty, the web to be fluted was treated with a coating of an (A) aqueous dispersion of wax and polymer to which was added 4% by weight of the release agent (P-O) described in Example 1. In another test (B), a dispersion, namely an aqueous solution of polyurethane, manufactured by Akzo Chemie, Cologne and sold in commerce under the trademark Cyclopal A, was used, and 4% by weight of the same composition (P-O) was added. In both tests, the treated web passed through the fluting rolls in satisfactory manner.

The amount of dry coating mix applied in (A) was about 5–7 g/m$^2$. The fluted paper showed full water repellency. In both tests, adherence to the liners after formation of the fluted board was very satisfactory. It can be seen that by incorporating the release agent of this invention, barriers of both wax and acrylic polymers, for instance, can be successfully applied to provide the fluted board with water resistant properties and exhibiting good resistance to collapse in high humidity conditions.

To those skilled in the art to which this invention relates, many changes in construction and widely differing embodiments and applications of the invention will suggest themselves without departing from the spirit and scope of the invention. The disclosures and the description herein are purely illustrative and are not intended to be in any sense limiting.

What is claimed is:

1. In a process for making coated paper products and for separating wet, semi-dry or dried coated paper or non-woven fabric from machine parts of an application unit or a drying roll, drum or felt, the improvement comprising the steps of (1) adding to a coating solution a release additive consisting essentially of:

(a) an amount of 0.5 to 6% by weight of said coating solution, of an aqueous solution consisting essentially of the reaction product of alkanolamine, selected from the group consisting of monoethanolamine, diethanolamine, triethanolamine, monoisopropanolamine, diisopropanolamine, triisopropanolamine, aminoethylethanolamine, diethylethanolamine and methyldiethanolamine, and a fatty acid wherein the carbon chain contains from 11 to 18 carbon atoms;

(b) said alkanolamine and said fatty acid being present in substantially equimolar proportions to each other;

(c) an agent to maintain the pH of said coating layer or film at from 8 to 10, and being volatilizable under the conditions of operation;

(d) an amount of a viscosity reducing substance to enable intimate admixture of the release agent with the wet coating formulation and to make the addition product easier to handle in its concentrated form; and (e) water and (2) applying said coating solution to the paper or fabric surfaces coming into contact with said machine parts.

2. A process as in claim 1 wherein said alkanolamine is diethanolamine.

3. A process as in claim 1 wherein said acid is oleic acid.

4. A process as in claim 1 wherein said agent to maintain pH is aqueous ammonia.

5. A process as in claim 1 wherein said viscosity-regulating substance is propionic acid.

6. In a process for making corrugated paperboard, the steps of improving the water-resistance of such paperboard comprising:

(a) applying a coating, adapted to provide water-resistance to said paperboard upon drying, to the surfaces of paperboard stock to be fluted;

(b) applying to said surfaces along with said coating a release composition consisting essentially of (1) an aqueous solution or dispersion of an addition product of substantially equimolar proportions of a fatty acid having from 11 to 18 carbon atoms and an alkanolamine selected from the group consisting of monoethanolamine, diethanolamine, triethanolamine, monoisopropanolamine, diisopropanolamine, triisopropanolamine, aminoethylethanolamine, diethylethanolamine and methyldiethanolamine, (2) an agent to maintain the pH of said composition from 8 to 10, and (3) a viscosity-regulating substance to enable uniform dispersion and intimate admixture of the release agent with the wet coating formulation and to make the addition product easier to handle in its concentrated form, and (c) passing said paperboard stock through fluting rolls to form corrugated paperboard from said fluting rolls upon exiting therefrom.

7. The process as described in claim 6 wherein said first-mentioned coating is selected from the group consisting of wax and acrylic polymer adhesive.

8. The process as described in claim 6 wherein said alkanolamine is diethanolamine.

* * * * *